United States Patent [19]

Assmann et al.

[11] Patent Number: 4,703,990

[45] Date of Patent: Nov. 3, 1987

[54] CONNECTOR FOR JOINING A MULTI-CONDUCTOR FLAT ELECTRIC CABLE TO OTHER CIRCUIT ELEMENTS

[75] Inventors: Dieter Assmann, Lüdenscheid; Holger Demmler, Altena, both of Fed. Rep. of Germany

[73] Assignee: Assmann Electronics Ltd., Ennis, Ireland

[21] Appl. No.: 914,828

[22] PCT Filed: Jan. 22, 1986

[86] PCT No.: PCT/DE86/00021

§ 371 Date: Sep. 23, 1986

§ 102(e) Date: Sep. 23, 1986

[87] PCT Pub. No.: WO86/04745

PCT Pub. Date: Aug. 14, 1986

[30] Foreign Application Priority Data

Feb. 1, 1985 [DE] Fed. Rep. of Germany ..... 3503412

[51] Int. Cl.[4] ..... H01R 4/24

[52] U.S. Cl. ..... 439/404

[58] Field of Search ..... 339/97 R, 97 P, 98, 339/99 R

[56] References Cited

U.S. PATENT DOCUMENTS

| | | | |
|---|---|---|---|
| 3,214,723 | 10/1965 | Dupre et al. | 339/99 R |
| 3,355,699 | 11/1967 | Oshva | 339/99 R |
| 3,958,853 | 5/1976 | Wilson | 339/99 R |

*Primary Examiner*—Joseph H. McGlyne

*Attorney, Agent, or Firm*—Karl F. Ross; Herbert Dubno

[57] ABSTRACT

In order to create a connector for joining a multi-conductor flat electric cable to other circuit elements, consisting of two clamp shell parts flatly fastenable to each other, of a multiple component insulation unit for receiving, holding and guiding of a plurality of contact pieces arranged in two parallel rows, whereby the upper and lower connection parts of each contact piece are connected together by a deformable, flat strip, with low material consumption and simple assembly possibilities, it is proposed that the insulation unit (3) be made of two half-shells (31, 32) whose separation line lies between the two rows of contact pieces, that the shell parts (31, 32) have massive layers which are part of the shell between the inner end portions of the connection parts (51, 52) of each contact piece (5) and that the recesses for receiving the connection parts (51, 52) of each contact piece (5) be each connected to a connecting channel open towards the separation line for the strip (53) connecting the connection parts.

6 Claims, 3 Drawing Figures

Figure 1:
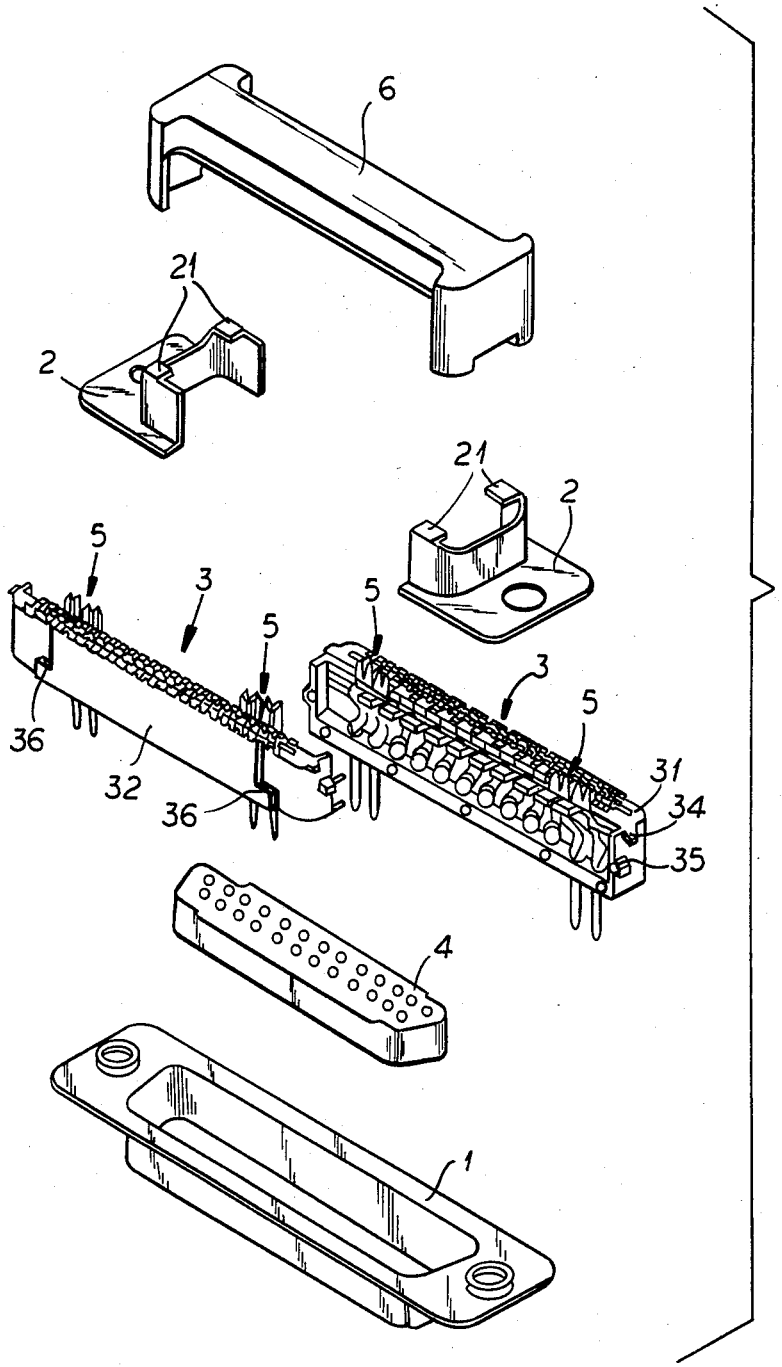

CONNECTOR FOR JOINING A MULTI-CONDUCTOR FLAT ELECTRIC CABLE TO OTHER CIRCUIT ELEMENTS

The invention relates to a connector for joining a multi-conductor flat electric cable to other circuit elements, consisting of two clamp half-shells, which can be flatly fastened against each other, a multiple-component insulation unit for receiving, fastening and guiding of a multitude of contact pieces, arranged in two parallel rows, whereby the insulation unit has an upper surface and a lower surface running parallelly thereto and is inserted between the half-shell parts open at their frontal ends, each contact piece having an upper connection part, extending in a right angle from the upper surface of the insulation unit up to a common distance therefrom, which upper connection parts have uniform first intervals between them, and a lower connection part, which extends at a right angle from the mentioned lower surface up to a common distance therefrom, which connection parts have a second uniform interval between them, which is different from the first uniform interval, whereby the upper and lower connection parts of each contact piece are connected to each other by a deformable flat strip.

Such connectors are known, for instance, from the European Application No. EP-A-38338.

These connectors have widely proven themselves in practice and are preferred over others due to their economy and simplicity in handling in wiring arrangements for the electrical connection of spaced apart construction parts.

In the case of the above-mentioned connectors, it is advantageous to keep their construction width and construction heights relatively small, so that the usual covering hood can be slid over them.

However, it is quite difficult to provide a protective hood for these connectors, when the connected flat cable exits the connector on one or both sides, respectively right or left at its upper area, since in this case the flat cable protrudes over the outer dimensions of the connector.

Furthermore, in the known connector it is disadvantageous that the insulating unit is made of a carrier and a trough-shaped insulating body. In order to mount the contact pieces, it is necessary to keep the carrier free, since the contact pieces have to be inserted on both sides of the carrier. After that, the carrier has to be imbedded in the trough-shaped insulating body and has to be connected arrestingly therewith, which requires additional efforts and the provision of additional fastening clamp. The material and labor expense for this connector is considerable.

Departing from this state of the art, the invention has the object to create a connector of the afore-described kind, which with a lower material consumption, facilitates the assembly, and, moreover, makes possible the angling of the flat cable connected to the connector in such a manner that the flat cable exiting the upper area either on one, or on both sides, can be bent so that it comes to lie within the range of the insulation unit, so that the common protection hoods can be slid over the unit.

In order to solve this problem, the invention proposes that the insulating body consist of two half-shells, whose separation line runs between the two rows of contact pieces, that the bottom of the half-shell forming the lower surface be correspondingly perforated for the passage of the lower connection parts of the contact pieces, that the receiving of the upper connection parts be achieved through adjusted recesses, open towards the separation line and towards the upper surface of the shell part holding the contact piece, as well as through a clamping means of the respective other half-shell, pressing the connection part towards the recess walling, whereby the contact rows are arranged parallelly offset with respect to each other, so that, when the half-shells are brought together, each clamping means of one half-shell opposes the upper connection part of the contact piece of the other half-shell, that the half-shells have massive support areas which are an integral part of the shell, located between the inner end portions of the contact parts of each connection piece and that the receiving areas for the connection parts of each contact piece are connected through a connection channel open also towards the separation plane, for the strip connecting the connection parts.

Due to the configuration of the insulating body made of two half-shells the material consumption is considerably lowered. Furthermore, the assembly is facilitated, insofar as the half-shells of the insulating unit can be positioned with one side on an under-layer, and in this position, the contact pieces can be inserted manually or by a machine.

In order to insert the contact pieces it is required that these be slid into a corresponding bore in the bottom of the half-shell with their lower connection part, normally a plug or a socket part, after that they can be swung towards the lateral wall of the half-shell, and there can be imbedded in the respective recesses and receiving areas. The locking of the contact pieces inserted this way takes place through the closing of the two half-shells at their openings facing each other, whereby clamping means insure an arresting in this assembly position. The support areas molded into the half-shell parts prevent the upper connection parts, for instance knife-blade contacts, from being pressed into the insulation body, during the insertion and imbedding of the corresponding flat strip cable, which would exclude a regular contact. Also, the molded support areas prevent the imbedding of the lower contact parts, when the plug-in connection with a corresponding electric appliance is made, so that here also a safe contact is achieved. Further, due to the half-shell configuration of the insulating unit, the possibility is created to place the contact pieces relatively deep inside, so that there is a distance between them and the contours of the insulating unit, which permits the bending of a flat strip cable so that the flat strip cable is located within the alingment of the insulating unit.

In a development it is proposed that the clamping means have a width corresponding to only a fraction, particularly to less than one-third, of the width of the upper connection parts.

Further, it is advantageous that the upper connection parts are located at a distance corresponding at least to the thickness of the flat cable, from the outer wall of the half shell, facing away from the separation line of the half-shells, running parallelly to this separation line.

Further, it is therefore advantageous when the connected flat strip cable does not protrude over the outline of the insulation body, and. the upper surface of the insulation body is covered in a manner known per se by a clamp bracket arrestingly supported on the insulation body, whereby the clamp bracket has retracted side edges, whose retraction has a width that corresponds approximately to the distance between the upper contact parts and the outer walling of the insulation unit.

A further economy of material is achieved due to the fact that the upper part of the clamp shell is constructed without intermediate walling, whereby the so-formed two end caps have locking means engageable with the insulation unit and passage openings for the fastening means for the support on the lower clamp shell part.

In addition, it is advantageously provided that the half-shells forming the insulation unit are lockable and/or glued and/or welded together at their lower and lateral edge portions at the separation line.

Figure 2:
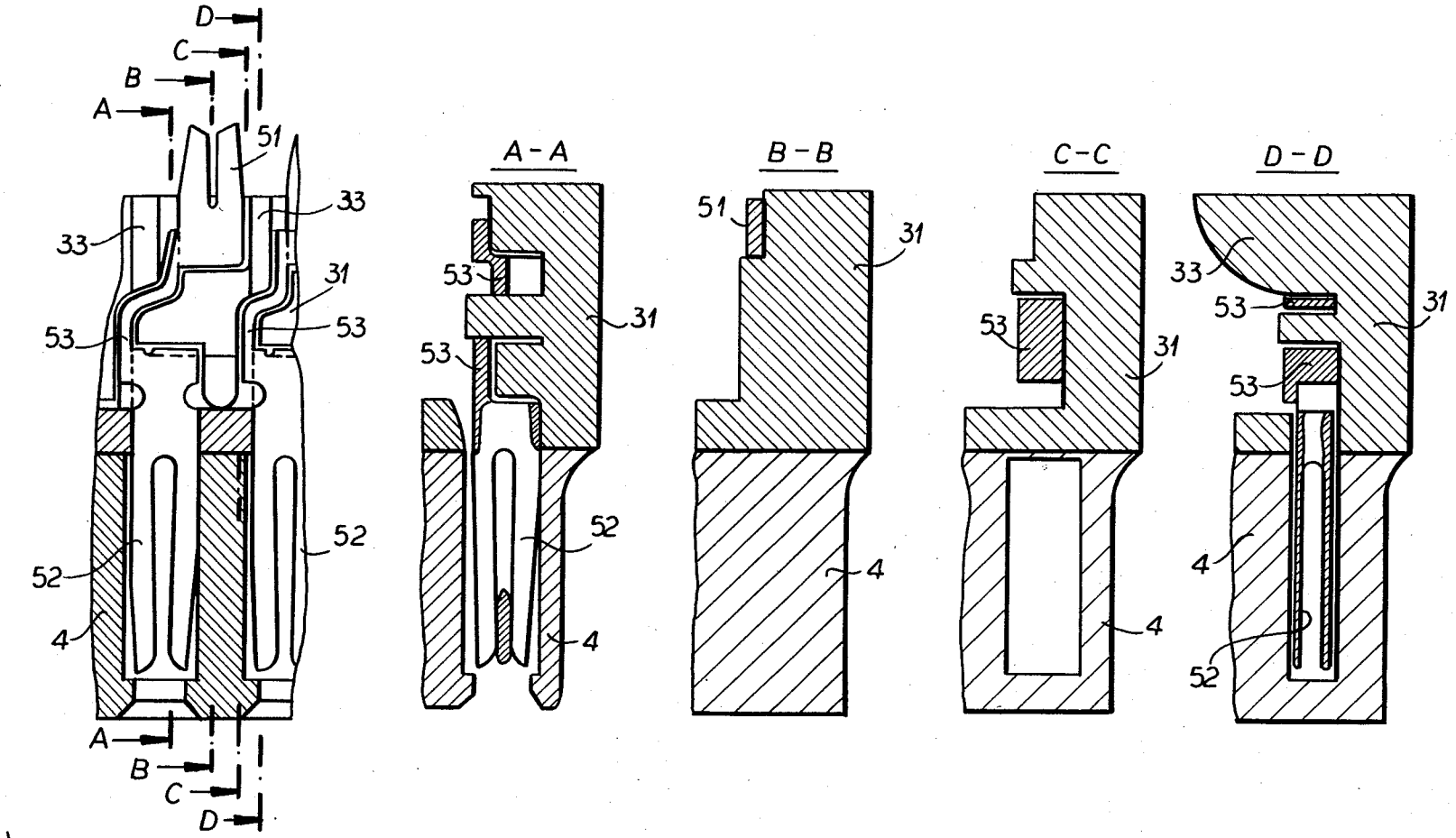
Figure 3:
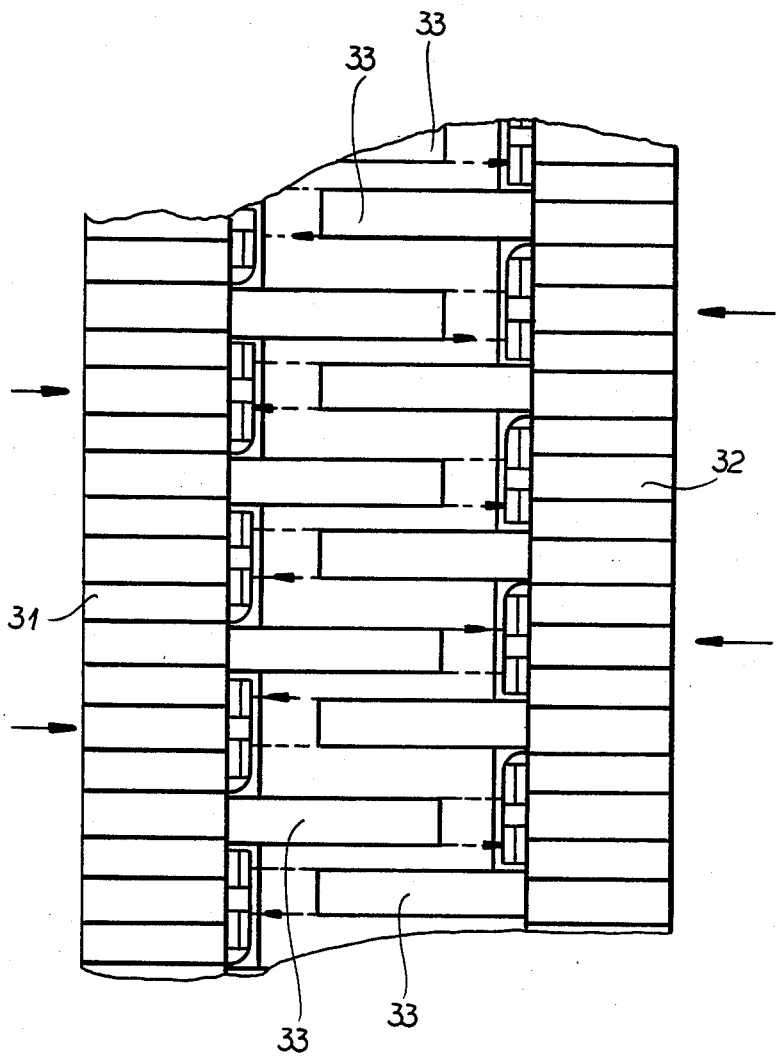

An embodiment example of the invention is represented in the drawing and described in detail in the following. It shows in:

FIG. 1 a connector in a blown-up view;

FIG. 2 a part of a half-shell of the insulation body of the connector according to the invention in a frontal view and at the section points a–d;

FIG. 3 a partial representation of the insulation unit in a top view.

The connector for joining of a multiconductor flat electric cable consists basically of two clamping shell halves 1, 2, preferably made of metal, which can be flatly fastened to each other, for instance, by screws or rivets, a multi-component insulation body 3,4, for receiving, holding and guiding of a multitude of contact pieces 5, arranged in two parallel rows, as well as of a lid, which is built as a clamp bracket 6. The insulation unit 3 has an upper surface and a lower surface, parallel thereto and is fixed between the frontally open clamp-shell parts 1, 2. Each contact piece 5 has an upper contact part 51, which extends at a right angle from the upper surface of the insulation unit 3, up to a common distance therefrom, whereby the upper connection parts 51 have a first uniform interval between them. Further, each contact piece 5 has a lower connection part 52, which extends at a right angle from the lower surface of the insulation unit 3, up to a common distance therefrom, whereby these connection parts also have a second uniform interval between them, which however is different from the first interval. The upper and lower connection parts 51, resp. 52 of each contact piece 5 are connected among them by a deformable, flat strip 53. For the case that the lower connection parts are female parts, a further insulation part 4 is provided, which serves already for the protection of these parts when the plug-in contact is made. As far as the lower connection parts 52 are shaped as male connectors, the insulation part 4 can be dispensed with.

The production of the contact pieces is performed in one piece, through a stamping, respectively bending process, whereby at first the contact pieces for one row are stamped or bent from a sheet-metal strip, still hanging together, whereby the different intervals between the upper and lower contact pieces is achieved through differentiated bending of the flat strip 53, during the otherwise identical formation of the contact pieces. These still connected row of contacts is then inserted into the insulation unit 3, as it will be described later. The separation of the material connection between the contact pieces takes place only after the mounting in the insulation body.

In accordance with the invention, the insulation unit 3 consists of two half-shells 31, 32, whose separation line lies between the two rows of contact pieces. The lower surface of the insulation unit is formed by the bottoms of the half-shells 31, 32, provided with bores for the passage of the lower connection parts 52 of the contact pieces 5. The receiving area for the upper connection parts 51 consists of the adjusted recesses of the shell part 31 resp. 32, holding the respective contact piece 5, open towards the separation line and towards the upper surface, as well as of a clamping part 33, pressing the connection part 51 against the recess walling of the respective other half-shell part 32, resp. 31. The contact piece rows are thereby parallelly offset with respect to each other, so that, when the shell parts are pressed together, each respective clamping part 33 of the one half-shell part 31, respectively 32, comes to be opposite to an upper connection parts 51 of the contact piece 5 of the other shell part 32, respectively 31. The shell halves 31, 32 have massive support areas which are part of the shell between the inner end portions of the connection parts 51 and 52 of each contact piece 5, which prevent an undesirable insertion of the connection parts during the imbedding of the flat strip cable, respectively when the plug-in contacts are established. The receiving areas for the connection parts 51 and 52 of each of the contact pieces 5 are each connected through a connecting chanel open towards the separation plane, for the strip 53 connecting the connection parts 51, 52. These connecting channels have differently shaped courses, depending on the various bending shapes of the strip 53.

In the embodiment example, the clamping parts 33 are only as wide as approximately half, preferably less than a third of the width of the upper connection parts 51 of the contact piece 5. This can be seen clearly especially in FIG. 3. In addition, the upper connection parts 51 are located at a distance from the outer walling of the half-shells facing away from the separation line of the half-shells 31, 32 and running parallelly to this separation line, which distance corresponds at least to the thickness of the flat cable to be connected with the connection parts 51. This way, it is possible to bend the flat cable upwardly, after connection with the connection parts 51, in such a manner that the outlines of the flat cable stay within the contours of the insulation unit housing 3. The lid shaped as a clamp bracket 6 serves the same purpose, it covers the upper surface of the insulation body 3 and presses the imbedded flat strip cable into the connection parts 51. For this purpose, the lid 6 is provided with retracted lateral edges, which can be clearly seen from FIG. 1. The retraction corresponds in width to approximately the distance of the upper connection parts 51 from the outer walling of the insulation body 3. The fastening of the lid 6 takes place over the arresting means 34, 35, as well as corresponding grooves in the lid 6, which are not shown in the drawing. The latch 34 serves for the preliminary locking, while the latch 35 insures the locking in the final arresting position. In order to save on material, the upper clamp shell half is made without an intermediate wall, as can be seen from FIG. 1. The two end caps built this way locking means 21 which engage with the insulation unit 3, overlapping the corresponding porjections 36 of the insulation body 3. It is also to be noted that the half-shells 31, 32 have, at their lower and lateral edge portions at the separation line, female and male parts for the formation of a plug-in or locking connection. In addition to that or as an alternative, these parts can be glued or welded together, or for instance, welded by ultrasonic welding.

In FIG. 2, it can be seen clearly how the lower and upper connection parts 51, resp. 52, are gripped due to the molded supports of the half-shell 31 for absorbing pressure forces and for insurance against displacement. Also from this Figure can clearly be seen the arrangement and shape of the clamp parts 33, with the sinuous path of their frontal edge. FIG. 1 shows that the contact pieces of the contact rows running parallely to each other, are offset with respect to each other and that the clamp parts 33 are in a tooth-like mutual engagement, when the two half shells 31, 32 are closed. The representation in FIG. 3 corresponds to the moment when the shell halves are brought together, shortly before their closing.

The invention is not limited to the embodiment example, but is widely variable within the framework of the disclosure.

We claim:

1. Connector for joining a multi-conductor flat electric cable to other circuit elements, consisting of two clamp half-shells which can be flatly fastened against each other, a multiple-component insulation unit for receiving, holding and guiding of a multitude of contact pieces arranged in two parallel rows, wherein the insulation unit has an upper surface and a lower surface parallel to the first, is fixed between the clamp half-shells which are open at their frontal end wherein each contact piece has an upper connection part extending at a right angle from the upper surface of the insulation body until it reaches a common distance therefrom, which upper connection parts have a uniform first interval between them, and a lower connection part extending at a right angle from the said lower surface until it reaches a common distance therefrom, which connection parts have between them a second uniform interval different from the first interval, whereby the upper and lower connection parts of each contact piece are connected all together by a deformable, flat strip, characterized by that the insulation unit (3) consists of two half-shells (31, 32), whose separation line lies between the two rows of contact pieces, that the bottom of the half-shell forming the lower bottom of the half-shells (31, 32) is perforated correspondingly for the passage of the lower connection parts (52) of the contact pieces (5), that the receiving area for the upper connection parts (51) is formed by adjusted recesses open towards the separation line and the upper surface of the half-shell (31, res. 32) holding the contact piece (5) as well as by clamp part (33) pressing the connection part (51) towards the recess walling of the respective other half-shell part (32, rep. 31), whereby the contact rows are arranged paralelly offset with respect to each other, so that a clamp part (33) of the one half-shell part (31, resp. 32) comes to stand oppositely to an upper connection part (51) of the contact piece (5) of the other half-shell part ( 32, resp. 31) when the two half-shells are closed, that the shell parts (31, 32) have massive support layers which are part of the shell between the inner end portions of the connection parts (51, 52) of each contact piece (5) and that the recesses for receiving the connection parts (51, 52) of each contact piece (5) are respectively connected through connection channel open towards the separation line, for the strip (53) connecting the connection parts.

2. Connector according to claim 1, characterized by that the clamp parts (33) have a width corersponding to only a fraction of the width of the upper connection part (51), particularly less than one-third of this width.

3. Connector according to claim 1, characterized by that the upper clamp half-shell (2) has no intermediate wall, whereby the two end caps formed in this manner are equipped with the latches lockable with the insulation body (3) and with the passage opening for the fastening means for holding to the lower clamp half-shell (1).

4. Connector according to claim 1, characterized by that the half-shells (31, 32) forming the insulation body (3) are locked and/or glued and/or welded at their lower and lateral edges lying in the separation line.

5. Connector according to claim 1, characterized by that the upper connection parts (51) have a distance, corresponding at least to the thickness of the flat cable, from the outer walling of the half-shells (31, resp. 32) facing away from the separation line of the half-shells (31, resp. 32) and running parallely to the separation line.

6. Connector according to claim 5, characterized by that the upper surface of the insulation unit (3) is coverable in a manner known per se by a clamp bracket (6) lockably mounted on the insulation body (3), whereby the clamp bracket (6) has retracted lateral edges, whose retraction has a width corresponding approximately to the distance between the upper connection parts (51) and the outer walling of the insulation unit (3).

* * * * *